United States Patent [19]

Lefebvre et al.

[11] 4,444,251

[45] Apr. 24, 1984

[54] COMBINED INSTALLATION COMPRISING AN ACTIVATION PUMP AND A SAFETY VALVE DISPOSED BELOW THIS PUMP, IN A HYDROCARBON PRODUCTION WELL

[75] Inventors: Hervé M. Lefebvre, Chartres; François C. Gueuret, Voisins le Bretonneux, both of France

[73] Assignee: Compagnie Francaise des Petroles, Paris, France

[21] Appl. No.: 445,869

[22] Filed: Dec. 1, 1982

[30] Foreign Application Priority Data

Dec. 2, 1981 [FR] France ..... 81 22543

[51] Int. Cl.[3] ..... E21B 34/10

[52] U.S. Cl. ..... 166/105; 166/321

[58] Field of Search ..... 166/105, 106, 108, 321, 166/319, 322, 324

[56] References Cited

U.S. PATENT DOCUMENTS

| | | | |
|---|---|---|---|
| 4,009,756 | 3/1977 | Zehren | 166/321 |
| 4,354,554 | 10/1982 | Calhoun | 166/321 |
| 4,356,205 | 9/1982 | Goldschild et al. | 166/321 |

*Primary Examiner*—William F. Pate, III

*Attorney, Agent, or Firm*—Sughrue, Mion, Zinn, Macpeak and Seas

[57] ABSTRACT

In a hydrocarbon production well in which effluent is activated by an activation pump installed in a production pipe in the well, a safety valve is disposed in the production pipe beneath the pump and is controlled for opening purposes by a control chamber which is provided with pressurized fluid present at the level of the pump. To this end an annular passage is provided inside the production pipe along a wall connecting the pump to the valve, the annular passage communicating at its ends with means for bringing it into communication with the pressurized fluid present at the level of the pump and the control chamber respectively.

6 Claims, 12 Drawing Figures

COMBINED INSTALLATION COMPRISING AN ACTIVATION PUMP AND A SAFETY VALVE DISPOSED BELOW THIS PUMP, IN A HYDROCARBON PRODUCTION WELL

The invention relates to a hydrocarbon production well in which the effluent is activated by an activation pump installed in a production pipe, and in which a safety valve disposed below this pump ensures security in the event of the eruption of the well.

It is important that the pump and safety valve should not be in unit with the production pipe and should be able to be withdrawn independently of this pipe. The pump and the valve must then form a removable unit independent of the production pipe or be installed separately in the latter. In the last-mentioned case, security at the well bottom is retained after removal of the pump, and the safety valve is advantageously installed in such a manner that it can be withdrawn by a simple cable operation.

In addition, control lines for a safety valve which are disposed outside the production pipe are inconvenient to handle and risk being damaged. It would therefore be of interest to be able to control a removable safety valve, which is disposed below an activation pump, without any connection disposed outside the production pipe.

One aim of the invention is to solve this problem by using, as fluid controlling the safety valve, either the pump driving fluid if the pump is of the hydraulic type or the fluid produced at the outlet of the pump, without hampering the construction of the pump and valve as removable components.

According to the invention there is provided an installation comprising an activation pump installed in a production pipe and a safety valve disposed below said activation pump and comprising an operating member and a control chamber, said operating member being movable inside said valve for opening said valve under the control of said control chamber, said control chamber being connectable to receive a pressurized fluid present at the level of the pump, wherein an annular passage is provided inside the production pipe along at least one wall connecting said pump to said valve and extending from said pump, where means are provided for bringing said passage into communication with said pressurised fluid present at pump level, to said valve, where said passage is in communication with said control chamber.

This annular passage may be bounded on the one hand by the actual valve body, which is extended as far as the pump, if a single removable unit comprising both the valve and the pump is formed. On the other hand, the annular passage may be bounded externally by the production pipe or be internally bounded by a wall inside the valve body. In the last-mentioned case, or if it is preferred to install the pump and the valve separately in the production pipe, the pump may be provided with a tubular extension at the bottom, and the said internal wall may be provided with a tubular extension at the top, the tubular extensions being adapted to slide sealingly one in the other so as to together form a continuous wall bounding internally the said annular passage.

Embodiment of the invention will now be described, by way of example only, with reference to the accompanying drawings.

Figure 3:
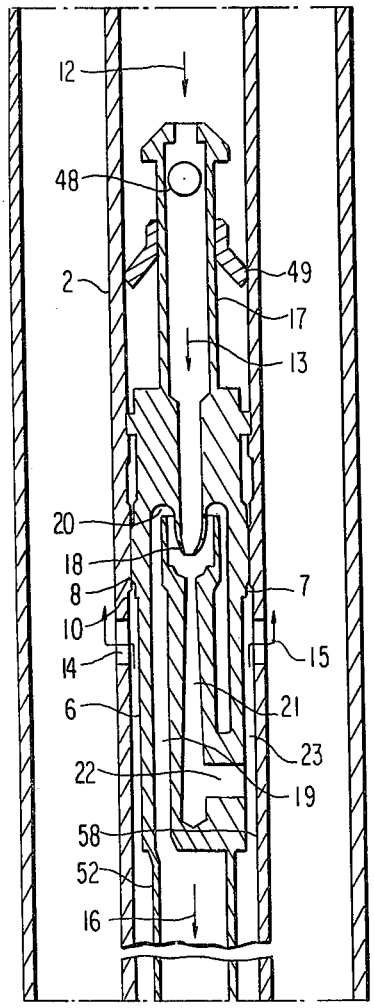
FIGS. 3 and 4 show a similar view of a modified embodiment.
Figure 4:
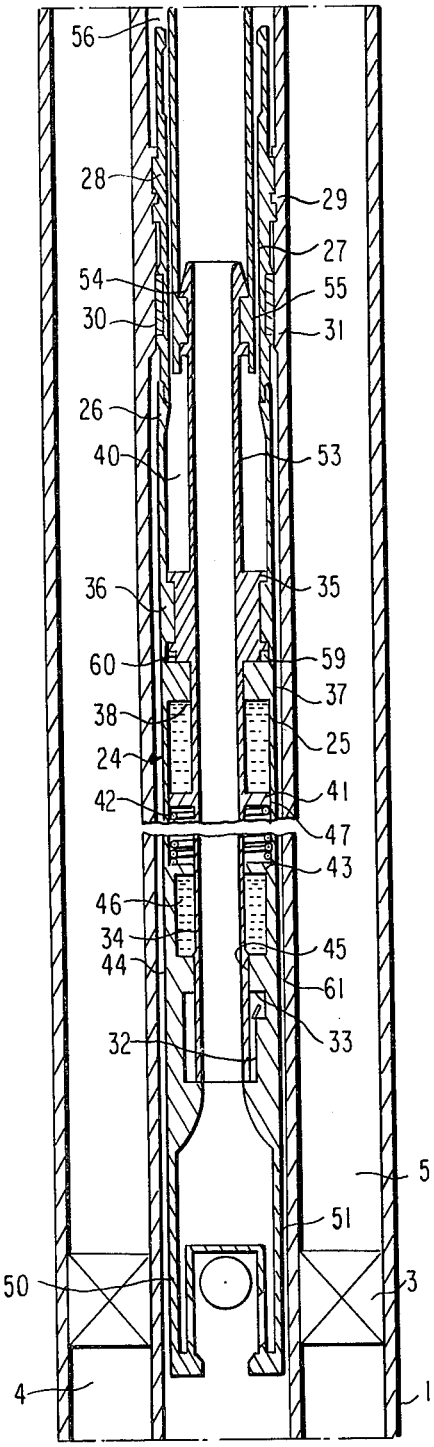
Figure 5:
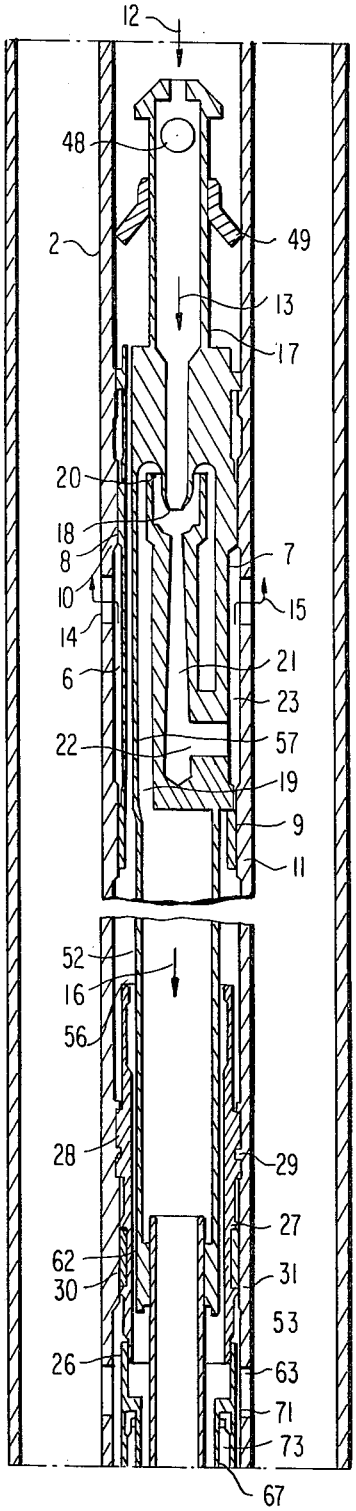
FIGS. 5 and 6 show two portions succeeding one another from top to bottom of another modified embodiment.
Figure 6:
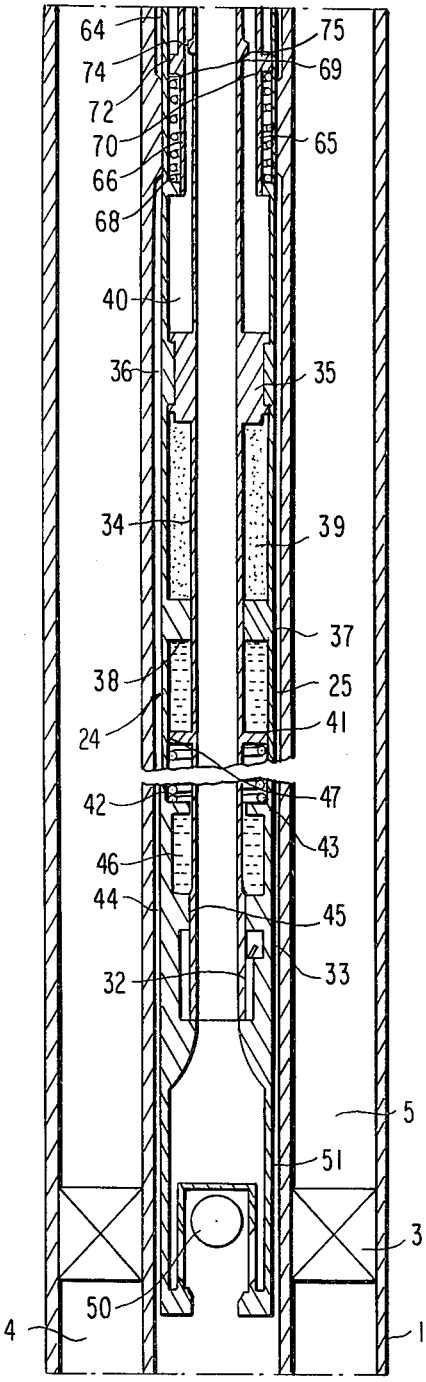
Figure 9:
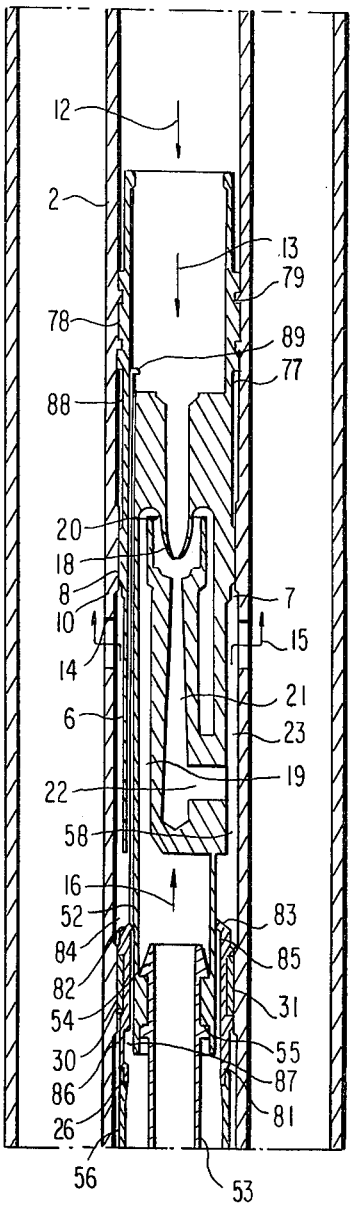
Figure 10:
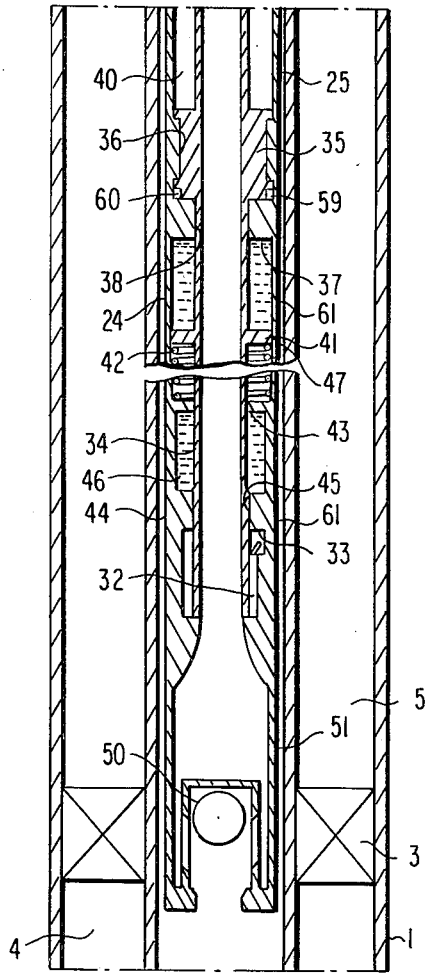
Figure 11:
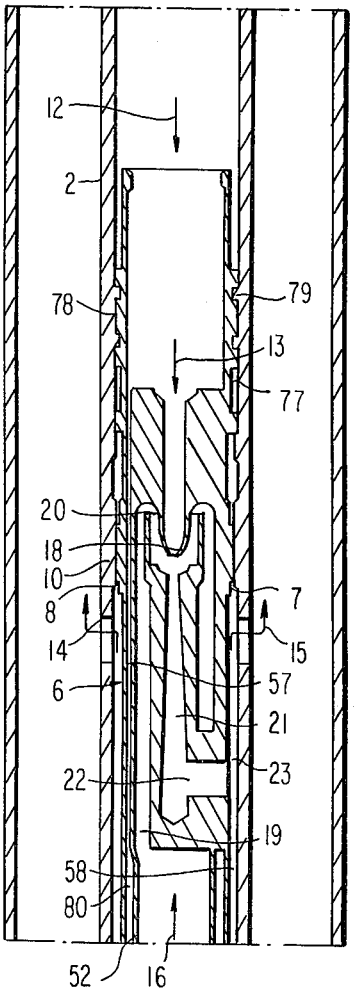
Figure 12:
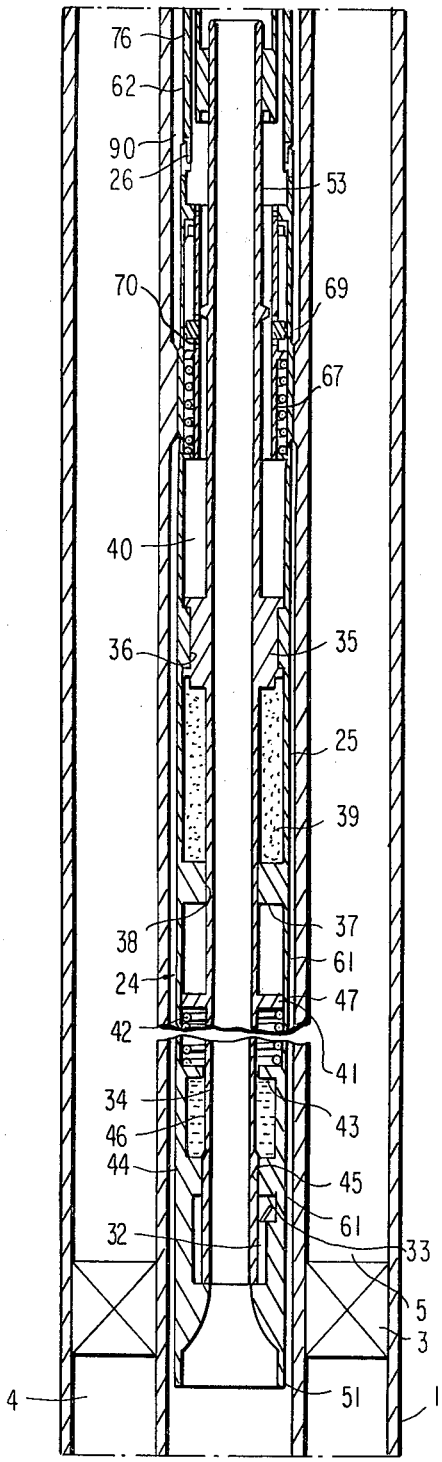

FIGS. 9 and 10 show two portions, succeeding one another from top to bottom, of a modification of the embodiment shown in FIGS. 3 and 4, wherein the pump and the valve together form a removable unit; and FIGS. 11 and 12 show two portions, succeeding one another from top to bottom, of a modification of the embodiment shown in FIGS. 5 and 6, wherein the pump and the valve together form a removable unit.

Figure 1:
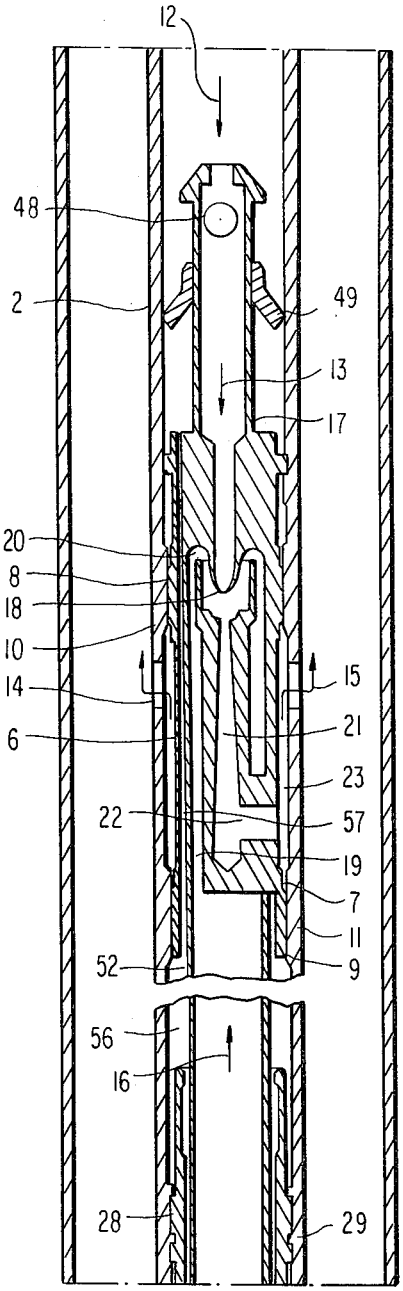
FIGS. 1 and 2 show, in longitudinal section, two portions, succeeding one another in the direction from top to bottom, of the bottom part of a petroleum production well, with an embodiment of a combined installation comprising an activation pump and a safety valve.
Figure 2:
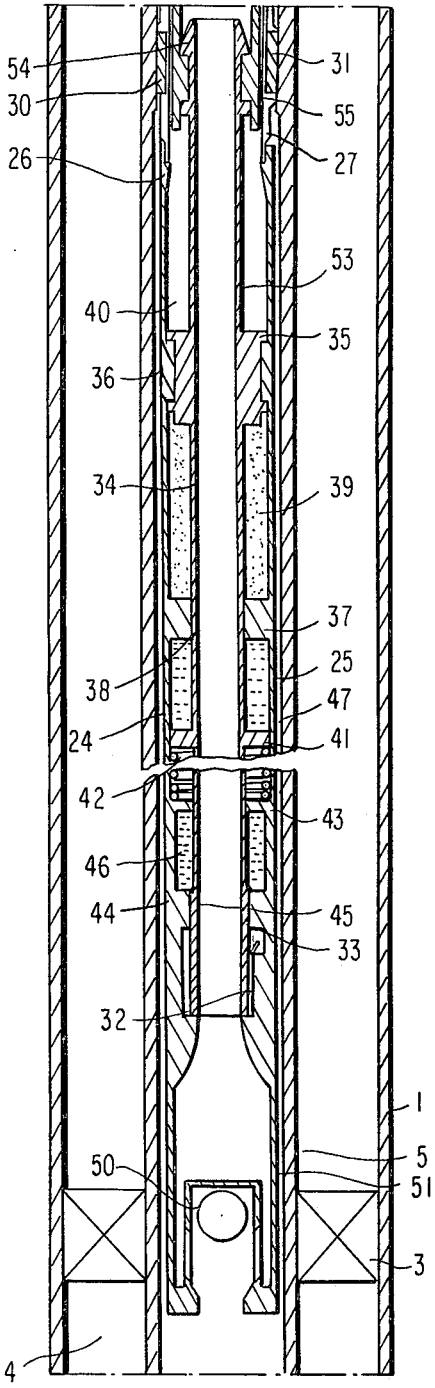

According to FIGS. 1 and 2, the petroleum well comprises a casing 1, inside which is disposed a production pipe or tubing 2. A sealing device or packer 3 is installed between the tubing 2 and the casing 1 in order to isolate the portion 4 of the annular space formed between the tubing and the casing at the bottom of the well from the portion 5 of the annular space lying above the packer 3.

An activation pump 6, which is of the hydraulic ejector type and which is retained in the tubing 2 by a collar bearing against an internal shoulder on the tubing, carries externally on its casing 7 two sealing packings, 8, 9 which are applied sealingly, inside the tubing 2, against bearing surfaces 10 and 11 on the latter.

The driving fluid of the pump 6 passes down from the surface in accordance with the arrow 12. Internally the pump 6 has passages for the driving fluid, which enters the pump in accordance with the arrow 13 and passes out of the tubing 2 through openings 14 in accordance with the arrows 15, then rising in the annular space 5, and also passages combined with the previously mentioned passages and intended for the effluent which rises from the bottom of the well in accordance with the arrow 16 and passes out of the tubing 2, after mixing with the driving fluid, in accordance with the arrows 15. These fluid passages comprise: a driving fluid inlet pipe 17 followed by an injector 18, a rising vertical effluent inlet passage 19 followed by an annular passage 20, in which the direction of flow of the effluent is reversed and which has its outlet downstream of the injector 18, and an ejector 21. The latter is disposed downstream of the injector 18 and of the effluent inlet facing the injector, and it sucks in a mixture of driving fluid and effluent, this mixture constituting the product fluid. This product fluid leaves the pump 6 through an opening 22, passes into a space 23 formed between the pump 6, the tubing 2 and the sealing packings 8 and 9, and passes out of the tubing 2 through the openings 14 in accordance with the arrows 15, then rising in the annular space 5.

Below the pump 6, but independently of it, a safety valve 24 is installed in the tubing 2. The body 25 of this safety valve is fastened at the top, by means of a screw coupling 26, to a lock mandrel 27 provided with anchoring means 28 cooperating with an anchoring sleeve or nipple 29 on the tubing 2. The lock mandrel 27 is provided externally with a sealing packing 30 which is applied against an internal shoulder 31 on the tubing 2.

The body 25 of the safety valve 24 carries a swinging flap 32, which is normally in the raised horizontal position, in which it bears against a seat 33 and closes the valve 24. The valve 24 is opened by the lowering of the flap 32 into the vertical position shown in FIG. 2, this lowering of the flap 32 being effected by the downward movement of an internal sleeve 34 sliding inside the body 25.

The sleeve 34 carries a first piston 35 provided with sealing packings 36 and sliding sealingly inside the body 25. A shoulder 37 on the body 25 is provided with a sealing packing 38 and is disposed below the piston 35, bounding together with the latter, and with the body 25 and the sleeve 34, a chamber 39 filled with a precompressed gas, for example nitrogen. Above the piston 35 is provided a chamber 40 which is the control chamber for the downward displacement of the internal sleeve 34, and which for this purpose receives a pressurised fluid coming from the pump 6, as will be seen later on.

The safety valve 24 is provided with a system returning it to the closed position. For this purpose the sleeve 34 carries a second piston 41 subjected to the action of a spring 42 which bears against a shoulder 43 inside the body 25, and which urges the sleeve 34 in the upward direction. Below the internal shoulder 43 the body 25 has a shoulder 44 which, by way of a sealing packing 45, bears against the sleeve 34. A chamber 46 bonded by the body 25, the sleeve 34, the shoulder 37, the sealing packing 38, the shoulder 44 and the sealing packing 45 is filled with oil, while a calibrated passage 47 is provided between the piston 41 and the body 25, in such a manner as to form a system of the shock absorber type which retards the displacement of the piston 41 and consequently of the sleeve 34.

In order to be able to raise the pump 6 by reversed pumping, that is to say the delivery of a pressurised fluid into the annular space 5, the pipe 17 of the pump 6 has been provided with a check valve 48 and with cups 49, and a foot valve 50 has been installed on an extension 51 at the bottom of the body 25.

The pump casing 7 carries at the bottom a tubular extension 52 coaxial with the tubing 2, and the internal sleeve 34 is provided at the top with a tubular extension likewise coaxial with the tubing 2. This tubular extension 53 has a diameter smaller than that of the tubular extension 52, and the length of these two tubular extensions is such that the tubular extension 53 penetrates into the tubular extension 52, while a shoulder 54 on the tubular extension 53 is provided with a sealing packing 55 and seals the junction of these two tubular extensions. An annular passage is thus formed between the tubing 2 and the tubular extensions 52 and 53. This annular passage 56 is in communication at the bottom with the control chamber 40, while at the top of this annular passage 56 at least one duct 57, which passes from top to bottom through the pump 7 and which transmits the pressure of the driving fluid prevailing above the pump 6, has its outlet.

FIGS. 3 and 4, in which most of the members shown in FIGS. 1 and 2 can be seen again, show a modified embodiment in which the product fluid passing out through the opening 22 is used as control fluid delivered into the chamber 40. The sealing packing 9 and the bearing surface 11 have been eliminated, in order to establish communication at 58 between the opening 22 and the annular passage 56, the duct 57 obviously being eliminated.

In addition, in this modified embodiment, the precompressed gas chamber 39 has been replaced by a chamber 59 communicating through openings 60 with the space 61 formed between the tubing 2 and the body 25 below the sealing packing 30. Use is thus made of the valve described in French Patent Application No. 8122544.

In the example shown in FIGS. 5 and 6, the components shown in FIGS. 1 and 2 are found again, with a slight modification at the junction of the tubular extensions 52 and 53, where it is the tubular extension 52 which carries a shoulder 62 provided with a sealing packing, but an arrangement has been added which, when the sleeve 34 rises, permits the replacement of the driving fluid in the chamber 40 by the product fluid present in the annular space 5.

For this purpose, openings 63 have been provided in the tubing 2, which bring the annular space 5 into communication with a space 64 inside the tubing 2, situated between the tubing 2, the body 25, the sealing packing 30 and an additional sealing packing 65 applied against a bearing surface 66 inside the tubing 2. A slide valve 67, urged upwards by a spring 68, when in the raised position shown in FIGS. 5, 6 and 7, brings the space 64 into communication with the chamber 40 by way of an aperture 69 provided in the body 25 and an aperture 70 provided in the said slide valve. On the other hand, when the driving fluid is under pressure, the slide valve 67 falls into the lower position, in which it enables the driving fluid to pass into the chamber 40 through two apertures 71 and 72 provided in the slide valve and an intermediate chamber 73, while a shoulder 74 on the sleeve 34 is provided with a sealing packing 75 applied against the slide valve 67 and prevents the direct passage of the driving fluid to the chamber 40. As soon as the pressure of the driving fluid is eased, the slide valve 67 rises again into the raised position and again brings the annular space 5 into communication with the chamber 40. In the drawing the positions of the various members shown correspond to the moment when the pressure of the driving fluid has been eased but the sleeve 34 has not yet started its upward movement.

These examples do not show the pressure equalisation systems which can be used for enabling the safety valve to be deanchored, and also do not show the surface installations which make it possible to effect hydraulic pumping and optionally reversed pumping. In many cases it will also be possible to provide at the surface a device, such as for example an adjustable back-pressure check valve, which provides an adjustable back-pressure in the annular space 5.

The procedure for opening the safety valve and starting pumping may be as follows:

At the surface the adjustable back-pressure in the annular space 5 is adjusted to approximately the maximum value Pc which the installation can withstand;

At the surface the driving fluid in the tubing 2 is gently pressurised to the value Pc, which brings about: the opening of the flap 32 of the safety valve through equalisation of the pressures on each side of the flap, and the complete opening of the flap 32 through the lowering of the internal sleeve 34;

The injection of the driving fluid into the tubing 2 is started, thus permitting the progressive starting of the pump 6 while holding the safety valve 24 open because of the pressure applied above the piston 35;

The pressure in the tubing 2 is increased to the desired value;

The back-pressure in the annular space 5 is progressively reduced so as to reach the flow pressure at the wall head.

The closing phase of the safety valve 24 takes place automatically when the pressure of the driving fluid is eased.

In cases where the control chamber 40 receives the driving fluid from the pump, it may be of interest to install at the inlet of the pump 6 a retarding means which produces a delay between the establishment of the driving fluid pressure above the pump and the admission of this driving fluid into the pump. The retarding means may, for example, be of the type described in the French Patent Application No. 8122542.

It is also possible to apply to the present invention other systems described in the French patent application which has just been mentioned, particularly the system for reducing the support force on the obturator of the valve, and the system comprising a valve combined with a precompressed gas chamber.

With the aid of FIGS. 7 to 12, a description will now be given of modifications of the three embodiments shown in FIGS. 1 to 6, in the case where the pump and the valve form a unit fixed above the pump and where the said annular passage is, at least in part, provided between the casing of this unit and the wall formed by the tubular extensions 52 and 53.

Figure 7:
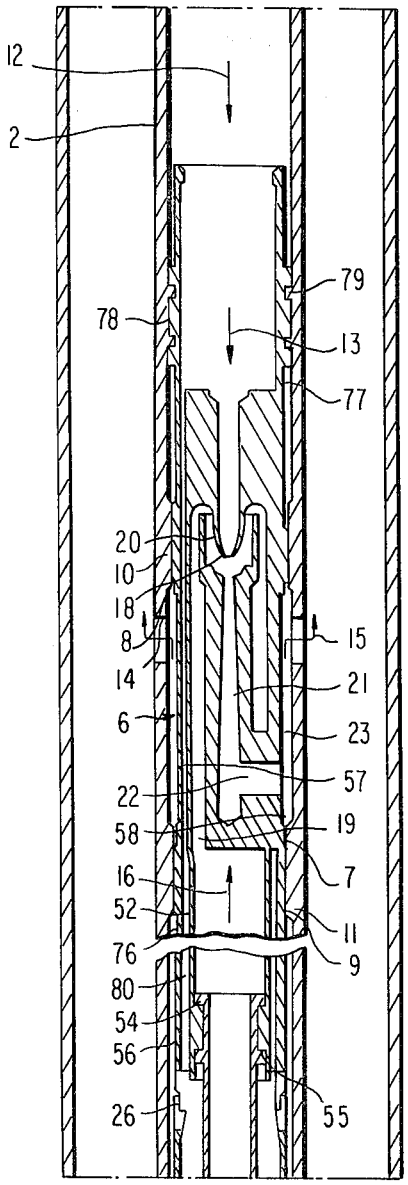
FIGS. 7 and 8 show two portions, succeeding one another from top to bottom, of a modification of the embodiment shown in FIGS. 1 and 2, wherein the pump and the valve together form a removable unit.
Figure 8:
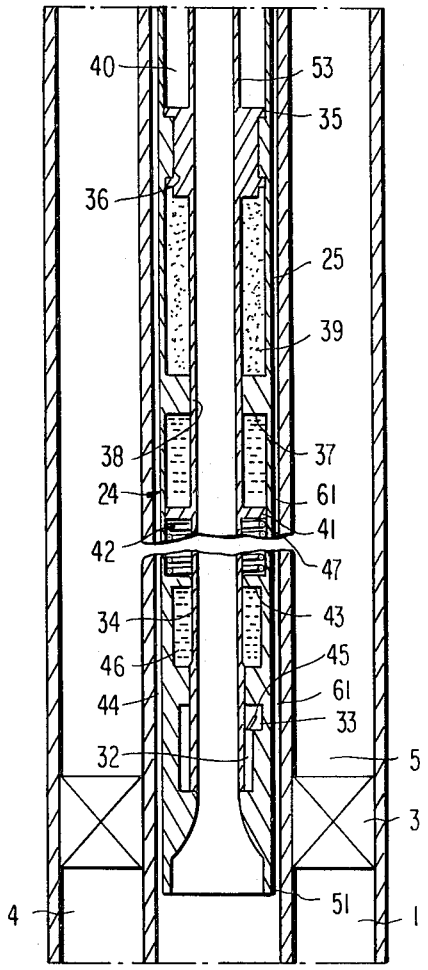

In the embodiment shown in FIGS. 7 and 8 the body 25 of the valve 24 is connected to the casing 7 of the pump 6 by a pipe 76 welded or otherwise fixed at its top to the casing 7, and screwed or otherwise fixed at the bottom to the body 25. The body 25 could also simply be extended upwards and itself welded to the casing 7. The sealing packing 30 and also the shoulder 31 are eliminated. The assembly comprising the pump and the valve is installed in the tubing 2 with the aid of a tubing extension 77 of the top part of the casing 7 and with the aid of anchoring means 78 and 79 carried respectively by the tubular extension 77 and by the tubing 2.

The annular passage serving for communication between the pump and the valve for the transmission of the valve opening fluid is here given the reference 80, and it is situated between the pipe 76 and the wall formed by the tubular extensions 52 and 53. The passage 80 is in communication at the top with the duct 57 and at the bottom with the control chamber 40.

The foot valve 50 has been dispensed with, since the chamber 39 is filled with a precompressed gas; the check valve 48, the cups 49 and the driving fluid inlet pipe 17 have also been eliminated. The lock mandrel 27 has obviously been dispensed with.

In the embodiment shown in FIGS. 9 and 10 the pump 6 is installed in the tubing 2 by the same means as in the embodiment shown in FIGS. 7 and 8: the tubular extension 77 and the anchoring means 78 and 79. The body 25 of the valve 24 is fixed to the casing 7 of the pump 6 by a tubular connection 81 welded at its top part 82 to the tubular extension 52. The top part 82 of this tubular extension is provided with through holes 83. The communication passage 58 thus leads into a first annular passage portion 84 lying between the tubular extension 52 and the tubing 2, and this first annular passage portion 84 is in communication through the openings 83 with a second annular passage portion 85 lying between the tubular connection 81 and the wall formed by the tubular extension 52 and 53, this second annular passage portion 85 leading into the control chamber 40.

The check valve 48, the cups 49 and the driving fluid inlet pipe 17 have been dispensed with, but the foot valve 50 and the chamber 59 communicating with the space 61 have been retained. The lock mandrel 27 has obviously been dispensed with.

The arrangement has been supplemented by a system equalising the pressures under the sealing packing 30 in order to permit deanchoring. This system comprises an aperture 86 provided in the tubular connection 81 to bring the space 61 into communication with the second annular passage portion 85, while a piston 87 closes this aperture 86 during the operation of the pump 6; the system also comprises a rod 88 for operating this piston and passing sealingly through the entire pump, this rod having, above the pump, a head 89 to which percussion may be applied when effecting the deanchoring, in order to enable the piston 87 to free the aperture 86.

The embodiment shown in FIGS. 11 and 12 provides a major simplification in comparison with the embodiment shown in FIGS. 5 and 6.

As in the two previous examples, the assembly comprising the pump and the valve is installed above the pump 6 by means of a tubular extension 77 and anchoring means 78 and 79, the mandrel 27 being dispensed with. The body 25 of the valve 24 is fixed to the casing 7 of the pump 6 by a pipe 76, as in the embodiment shown in FIGS. 7 and 8.

The sealing packings 9 and 30 have been eliminated, so that the outlet 22 of the pump 6 and the space 23 are connected to an auxiliary passage 90 lying between the tubing 2, on the one hand, and the pipe 76 and the body 25 on the other hand. This auxiliary passage 90 serves the same purpose as the internal space 64 in the embodiment shown in FIGS. 5 and 6.

The foot valve 50 has been eliminated, since the chamber 39 is filled with a precompressed gas; the check valve 48, the cups 49 and the driving fluid inlet pipe 17 have also been dispensed with. If it were desired to replace the chamber 3 with a chamber 59 connected to the space 61, as in the example shown in FIGS. 9 and 10, the foot valve 50 would be retained and a system would be installed for the equalisation of pressure at the level of the sealing packing 65, for example a system of the type provided in the embodiment shown in FIGS. 9 and 10.

It will be observed that an annular passage such as the auxiliary passage 90 could serve, in other modified embodiments not illustrated here, to introduce into a control chamber, such as the chamber 40, a pressurised fluid present at the level of the pump, particularly the product fluid.

It will be understood that numerous other modifications could be made without departing from the scope of the present invention.

What is claimed is:

1. An installation comprising an activation pump installed in a production pipe and a safety valve disposed below said activation pump and comprising an operating member and a control chamber, said operating member being movable inside said valve for opening said valve under the control of said control chamber, said control chamber being connectable to receive a pressurised fluid present at the level of the pump, wherein an annular passage is provided inside the production pipe along at least one wall connecting said pump to said valve and extending from said pump, where means are provided for bringing said passage into communication with said pressurised fluid present at pump level, to said valve, where said passage is in communication with said control chamber.

2. An installation according to claim 1, wherein said pump is provided with a tubular extension at its lower end and said valve is provided with a tubular extension at its upper end, said tubular extensions being adapted to slide sealingly one in the other such that together they form a wall internally bonding said annular passage.

3. An installation according to claim 1, wherein a duct passes through said pump from an upper part to a lower part, said duct connecting the upper part of said pump to said annular passage.

4. An installation according to claim 1, wherein communication means is provided between an outlet aperture of said pump and said annular passage.

5. An installation according to claim 3, wherein the output of said pump passes into an annular space surrounding the production pipe, and apertures are provided in the production pipe and a slide valve is arranged to bring said control chamber into communication either with said annular passage or with said apertures depending on whether said annular passage is or is not under pressure.

6. An installation according to claim 3, wherein the casing of said pump is connected to the body of said valve by a pipe, the output of said pump passes through a space between said casing of said pump and said production pipe, an auxiliary passage is provided between said production pipe on the one hand and said pipe and said body of said valve on the other hand, which auxiliary passage is in communication with said space, and a slide valve is arranged so as to bring said control chamber into communication either with said annular passage or with said auxiliary passage, depending on whether said annular passage is or is not under pressure.

* * * * *